United States Patent [19]

Williams

[11] 4,452,400

[45] Jun. 5, 1984

[54] ROTARY SHREDDING APPARATUS

[75] Inventor: Robert M. Williams, Ladue, Mo.

[73] Assignee: Williams Patent Crusher and Pulverizer Company, St. Louis, Mo.

[21] Appl. No.: 530,949

[22] Filed: Sep. 12, 1983

Related U.S. Application Data

[63] Continuation of Ser. No. 323,807, Nov. 23, 1981, abandoned.

[51] Int. Cl.[3] ..... B02C 25/00

[52] U.S. Cl. ..... 241/36; 241/236

[58] Field of Search ..... 241/30, 33, 36, 236, 241/235, 34, 35, 63, 64

[56] References Cited

U.S. PATENT DOCUMENTS

| | | | |
|---|---|---|---|
| 2,674,231 | 4/1954 | Erickson . | |
| 2,984,985 | 5/1961 | MacMillin . | |
| 3,336,861 | 8/1967 | Clar . | |
| 3,366,016 | 1/1968 | Anderson . | |
| 3,502,276 | 3/1970 | Panning et al. . | |
| 3,845,907 | 11/1974 | Schwarz . | |
| 3,860,180 | 1/1975 | Goldhammer . | |
| 3,868,062 | 2/1975 | Cunningham et al. | 241/36 |
| 3,981,455 | 9/1976 | Kaczmarek . | |
| 4,034,918 | 7/1977 | Culbertson et al. | 241/36 |
| 4,035,790 | 7/1977 | Farmer | 241/36 |

OTHER PUBLICATIONS

The Coats Tire Shredder Spec. Sheet, 1974.

Fluid Power Handbook & Directory, 1974–1975.

*Primary Examiner*—Mark Rosenbaum

*Attorney, Agent, or Firm*—Gravely, Lieder & Woodruff

[57] ABSTRACT

Rotary shredding apparatus for processing materials of various sorts in which the hydraulic drive for the counterrotating cutter shafts comprises a reversible hydraulic motor supplied with pressure fluid under the directional control of a fluid flow reversing valve. The flow reversing valve is controlled by a zero speed responsive device for sensing jam conditions that could stop cutter shaft rotation, thereby placing the valve in a control system which is independent of the pressure conditions in the fluid pressure system so that the hydraulic motor will continue to be supplied with pressure fluid up to the limit set by the usual pressure relief means.

7 Claims, 5 Drawing Figures

FIG. 1
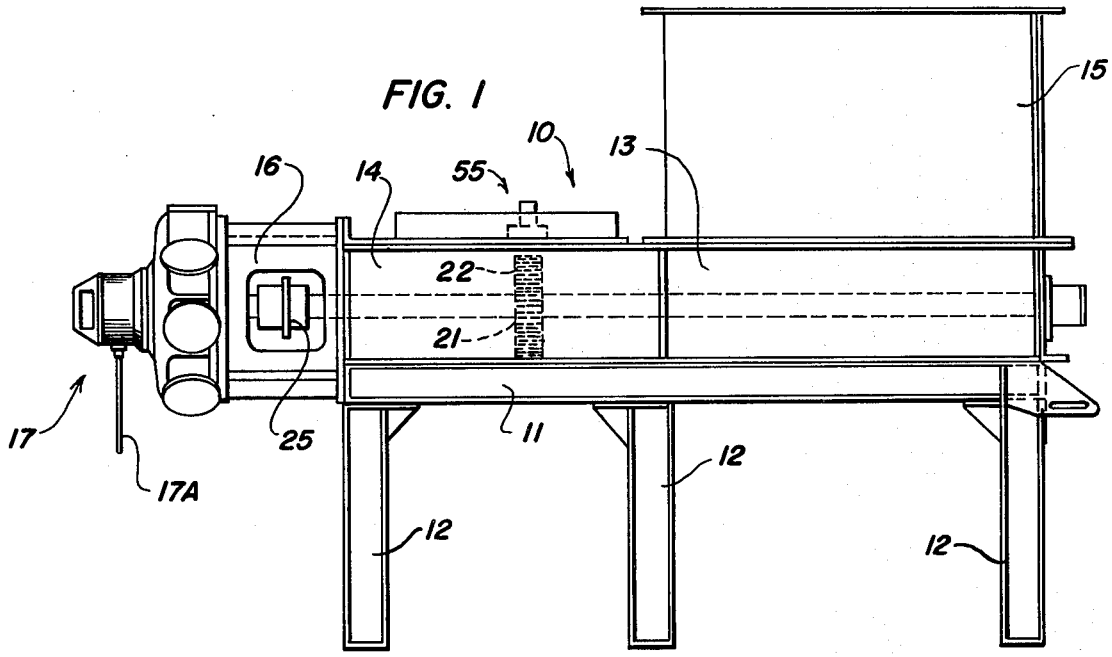
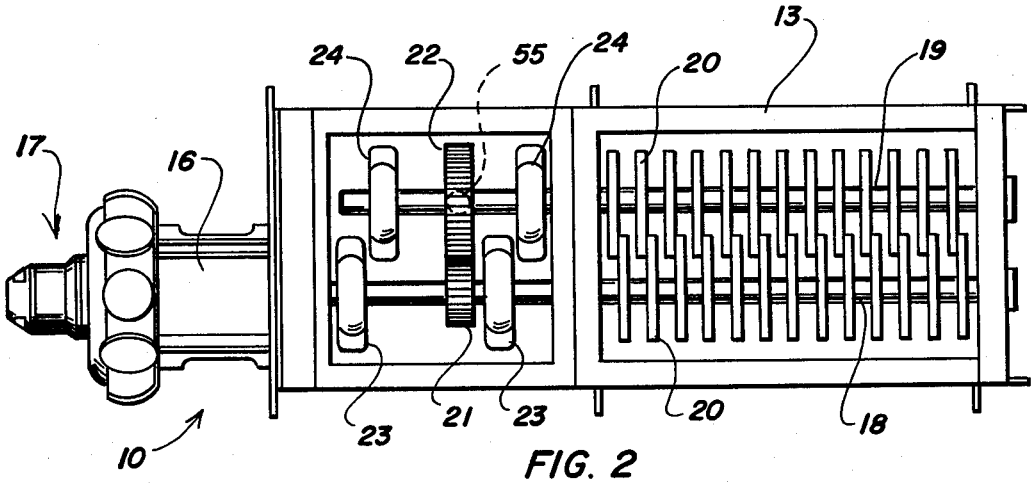
FIG. 2
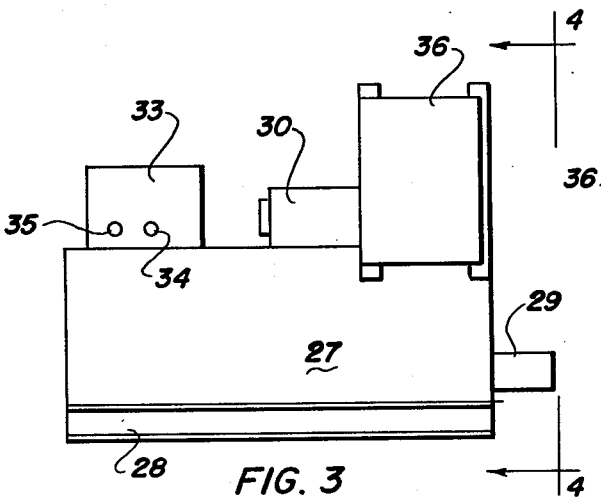
FIG. 3
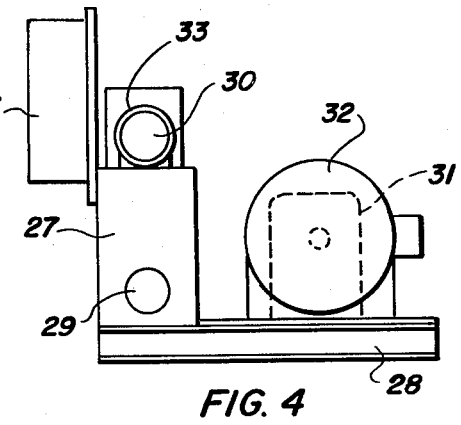
FIG. 4

ROTARY SHREDDING APPARATUS

This application is a continuation of the prior application, Ser. No. 323,807, filed Nov. 23, 1981, now abandoned.

BACKGROUND OF THE INVENTION

1. Field of the Invention

The present invention relates to rotary shredding apparatus and more particularly to a control system for operating the rotary hydraulic motor so that if the shredder jams because of the character of material thrown into the hopper it will automatically correct the jammed condition by going into a reverse rotational mode for a limited time period.

2. Description of the Prior Art

The presently known prior art relating to material shredding apparatus of rotary type driven by hydraulic fluid pressure motors or by electrical motors includes such examples as are disclosed in U.S. Patents Panning et al No. 3,502,276 of Mar. 24, 1970; Schwarz No. 3,845,907 of Nov. 5, 1974; Goldhammer No. 3,860,180 of Jan. 14, 1975; Cunningham et al No. 3,868,062 of Feb. 25, 1975; Kaczmarek No. 3,981,455 of Sept. 21, 1976; and Culbertson et al No. 4,034,918 of July 12, 1977.

It is also known that hydraulic pressure fluid systems can be operated in opposite directions by flow reversing means responsive to manual operation, or be electrically operated in response to fluid pressure means. Presently known prior art U.S. Patents in this class of systems includes Erickson No. 2,674,231 of Apr. 6, 1954; MacMillin No. 2,984,985 of May 23, 1961; Clar No. 3,336,861 of Aug. 22, 1967; and Anderson No. 3,366,016 of Jan. 30, 1968.

General information on hydraulic motors and components, and on fluid motor circuits is available in the Fluid Power Handbook & Directory 1974–75 by Hydraulics & Pneumatics.

There are problems with the electric motor and with the hydraulic motor drives for shredder apparatus as these drives are known at the present time. In the electric motor drives for low horsepower motors, frequent reversing is believed to be permissible because the motor is small enough to be easily reversed without overheating or incurring the tendency to burn out. However, as electric motor horsepower increases into the 100 H.P. range or more, the danger of burn out greatly increases, and is objectionable for that reason as the source of power for driving the counterrotating cutter shafts.

The shredder apparatus currently in use employs electric motor driven hydraulic pumps which supply the necessary power for hydraulic motors of 100 H.P. and larger. Instead of reversing the electric motors in such apparatus, control means is employed to reverse the pump if employed in a closed-loop system or to reverse a flow reversing valve means without reversing the pump, as used in an open-loop system. It has been the practice to control the flow reversing valve by either a hydraulic reversing control, or by electric solenoid means, either means being subject to fluid pressure in the system. When fluid pressure responsive means is employed, as in 3,868,062 or 4,034,918 shredder apparatus, there is a high pressure "load" which develops when the cutter elements on the counterrotating shafts jam or encounter hard to shred material.

It is known in systems relying on fluid pressure responsive electrical switches that the electrical control means associated with such switches rely upon make-or-break contactor elements, as is shown in 4,034,918 or in 3,336,861. These types of electrical components are easily responsive to vibration, and the contact surfaces become pitted from frequent opening and closing operations. In fluid pressure systems there is a need for a pressure relief valve, in addition to the flow reversing valve means, so that for correct operation it is necessary to make two adjustments, one being to respond to jam conditions, and the second being to relieve the system against over-pressure damage. Wrong adjustments can be made and if the relief valve is adjusted to open at a lower pressure than the pressure responsive switch in the reversing control system, there will be no way of knowing, short of visual inspection, whether the shredder has reversed as it is suppose to do when a jam occurs.

Furthermore, in hydraulic pressure responsive control systems, the relief pressure valve setting determines the maximum pressure available, but because the pressure responsive switch for sensing a jam is set to operate at a pressure less than the relief pressure, the maximum pressure is never available for effecting the shredding function of the apparatus.

BRIEF SUMMARY OF THE INVENTION

According to the present invention the problems encountered in the prior art are overcome by eliminating pressure sensing means and electrical relay contacts that are subject to vibration. In place of the troublesome and mechanical electrical control elements which have a slow responsive time, one of the principal objects of the present invention is to eliminate all such prior art elements, and embody control means having no moving contacts so that reliability can be assured, and low maintenance can be expected.

The primary object of the present invention is concerned with the operation of a material shredder having a hydraulic motor operating counterrotating cutter shafts and supplied with pressure fluid from a hydraulic pump connected to the hydraulic motor through a pressure fluid circuit, and more particularly, it is concerned with the improvement which comprises a pressure relief means in the fluid circuit which establishes the maximum pressure of the fluid being supplied to the hydraulic motor, a pressure fluid flow reversing means in the fluid circuit for selectively reversing the operation of the hydraulic motor and counterrotating shafts from a normal forward shredding direction, and motion detecting means in the shredder positioned to follow the operation of the hydraulic motor and counterrotating cutter shafts and detect stoppage of the normal forward operation thereof. An important feature of the improvement is embodied in a control system operably connecting the pressure fluid reversing means and the motion detecting means, the control system operating upon the motion detecting means detecting stoppage of the hydraulic motor and counterrotating shafts for measuring the duration of such stoppage for a predetermined time period, for operating the flow reversing means to reverse the hydraulic motor means and counterrotating shafts when the predetermined time period is exceeded, and for reestablishing the normal foward direction of the hydraulic motor and counterrotating shafts after a further predetermined time period has elapsed, the control system and motion detecting means being independent of the maximum pressure limit imposed in the pressure fluid circuit by the pressure relief means so that the hydraulic motor is supplied with pressure fluid substantially at the maximum pressure established by the pressure relief means.

It is also an object to provide control means of a programmable character which will permit a control system to be tailored to the requirements of the user of the rotary shredding apparatus. By providing a programmable type control it will be possible to match the throughput of the rotary shredding apparatus with any primary or secondary machinery which is associated with the shredding apparatus, thereby allowing the shredder control system to be incorporated into a distributive control system for an entire plant process.

It is also an object of the present invention to provide a programmable control which can be changed or modified so that a standard type of control system can be provided with the ability to tailor the mode of operation to each customer's need with no electrical or mechanical modifications to the control.

It is a further object of the present invention to provide a shredding apparatus with means that is independent of the hydraulic fluid pressure characteristics and develops its primary control signal from a part of the rotating system of the shredder through the use of direct rotary reading sensors which are sufficiently fast acting to be able to sense the speed of a rotating element and cause hydraulic flow reversal to occur on a time dependent schedule.

A still further object of the present invention is to utilize control means which will have the ability to function in respect of a hydraulically driven rotary shredding apparatus without the use of a pressure responsive device as is found in hydraulic systems of the prior art.

The foregoing objects, features and advantages of the present invention will be set forth in more detail in relation to a presently preferred embodiment thereof.

BRIEF DESCRIPTION OF THE DRAWINGS

A presently preferred embodiment of the rotary shredding apparatus is disclosed in the accompanying drawings wherein:

FIG. 1 is a side elevational view of the shredder apparatus;

FIG. 2 is a plan view looking into the hopper of the shredder apparatus and showing schematically the drive gear train and counter rotating cutter shafts associated with a radial piston hydraulic motor;

FIG. 3 is a side view of a hydraulic power pack associated with the present rotary shredding apparatus;

FIG. 4 is a view of the power pack from one end thereof as seen along line 4—4 in FIG. 3.

DETAILED DESCRIPTION OF THE PREFERRED EMBODIMENT

Figure 5:
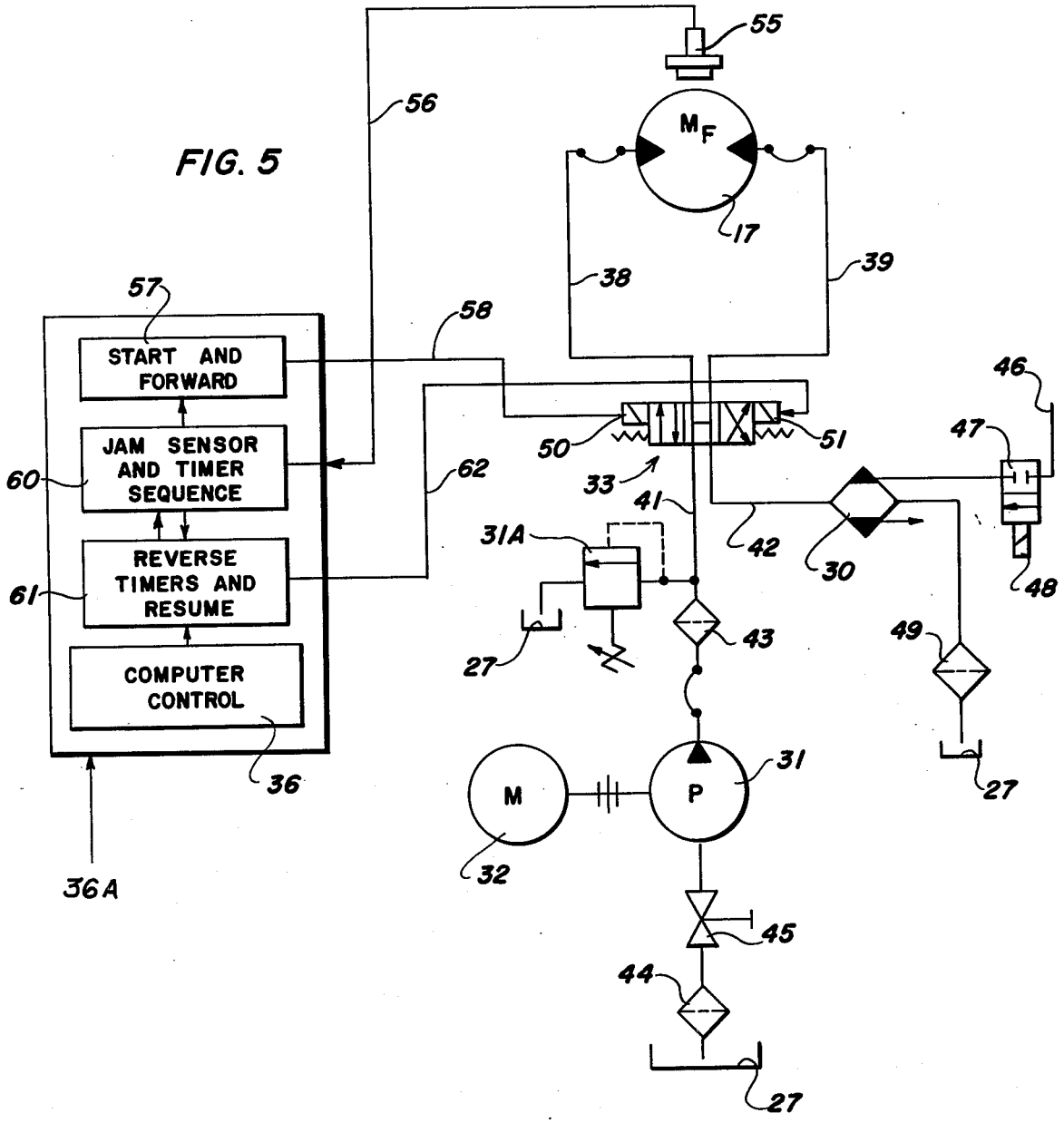
FIG. 5 is a schematic hydraulic and electrical control circuit associated with the reversible hydraulic motor for driving the shredder.

Referring to the drawings, the shredder 10 is shown in side elevation and in plan view of FIGS. 1 and 2. FIG. 1 shows the frame 11 on supporting legs 12 for carrying a shredding box 13 and an adjoining gear box 14. The box 13 is provided with a material receiving hopper 15, while the gear box 14 supports a coupling bracket 16 and a radial piston hydraulic motor 17 coupled to a hydraulic power pack by suitable conduits 17A.

In FIG. 2, which is a plan view looking down on the shredder, the shredding box 13 operatively supports a pair of rotary shafts 18 and 19, each of which is provided with cooperating intermeshing disc-type cutters 20 of any suitable character. The cover on the gear box 14 has been removed to reveal a train of gears 21 and 22. The gear 21 is located between shaft bearings 23 for shaft 18, and gear 22 is on shaft 19 between shaft bearings 24.

Shaft 18 is coupled by suitable coupling 25 in bracket 16 to the output shaft (not shown) of the hydraulic motor 17. In this arrangement, the motor 17 rotates shaft 18 at one speed, and through a suitable gear ratio between gears 21 and 22, the second shaft is counterrotated at a different speed. In the preferred embodiment shaft 18 is rotated at a higher speed than shaft 19 so that the cutter discs 20 on those shafts will effectively rip, tear, and break material thrown into the hopper 15.

Turning now to FIGS. 3 and 4, there has been illustrated a suitable hydraulic power pack comprised of a reservoir or tank 27 mounted on a base 28 and provided with an immersion heater 29 in the event that the hydraulic fluid needs to be controlled as to temperature. The tank supports a water type hydraulic fluid cooler unit 30 which is associated with a hydraulic pump shown in dotted outline at 31 behind a pump operating electrical motor 32. The pump delivers hydraulic fluid to a flow control valve means 33, and the valve is provided with a pair of ports 34 and 35 connected by suitable conduits or flexible hoses indicated collectively at 17A since they function as delivery and return lines alternately in supplying the reversible hydraulic motor 17. As noted, the ports 34 and 35 are alternately used for inlets and outlets of the hydraulic fluid, depending on the direction of rotation of the hydraulic motor 17. Also supported by the tank 27 is a control box 36 with power supply 36A for a programmable controller mounted therein.

Turning now to FIG. 5, there is shown schematically the hydraulic reversible motor 17 having fluid pressure hoses 38 and 39 leading through a 4-way 3-position hydraulic valve 33 to a hydraulic fluid supply line 41 and to a hydraulic fluid return line 42. Line 41 is connected through a filter 43 to the hydraulic pump 31 driven by the electric motor 32. The pump 31 draws its hydraulic fluid from the reservoir or tank 27 through a filter 44 and the suction line for the pump 31 is provided with a shut-off valve 45. The fluid return line 42 is directed through the cooler 30 of a water cooled character supplied from a cooling water source 46 under the control of valve 47 which is made subject to a solenoid element 48 under the control of the computer 36. The returning hydraulic fluid, after passing through the cooler, is directed through a filter 49 and returns to the tank 27. The hydraulic pressure system is provided with a safety relief valve 31A, as is well known.

The direction of rotation of the hydraulic motor 17 is directly under the control of the computer 36 which, in turn, operates the flow control valve 33 through a predetermined program of sequential energization of solenoids 50 and 51 associated with the shiftable spool (not shown) in the valve 33. A computer 36 is schematically shown, but such means may be an Omron programmable controller, SYSMAC-MO, which combines a program console suitable for CZ Unilog Modules, such a controller is made by Omron Electronics Inc., Schaumburg, Ill. The solenoids 50 and 51 and the valve 33 are also shown schematically, and in FIG. 5. the valve is positioned in its centered or neutral position so that the motor 17 will not operate when the pump 31 is started up. When it is desired to operate motor 17 for normal shredding the corresponding program in computer 36 energizes solenoid 50 which shifts the valve spool to the left, thereby completing a flow connection from conduit 41 to conduit 38 for forward rotation of motor 17. The hydraulic fluid is returned through conduit 39 and conduit 42 to the tank 27. If a jam occurs, the motor 17 needs to be reversed. A predetermined sequence occurs so solenoid 50 is deenergized and spring means returns the valve spool to the center position before solenoid 51 is energized to shift the valve spool to the right so that the hydraulic fluid supply conduit 41 now is connected into conduit 39, and the hydraulic fluid is returned through conduit 38 to conduit 42. After reversing for a predetermined time the forward sequence resumes.

The presently preferred system for controlling the operation of the shredder drive motor 17 includes signal generating means such as an eddy current sensor 55 which is located, as indicated in FIGS. 1 and 2, where it may respond to the speed of rotation of gear 22. That is to say, the eddy current sensor 55 created a magnetic field through which the gear teeth move, and the sensor generates pulses or signals which are transmitted through lead 56 to the computer control center 36. Generally, the computer control 36 counts the pulses which are created by both the passage of gear teeth and spaces between the gear teeth through the magnetic field. The character of the pulse is high or low. It is high if a gear tooth is in the magnetic field and low with a space between gear teeth in the magnetic field. The control will sense when the pulse is high or low at the time the gear stops. A control sequence is initiated because the sensor indicates to the control that the cutter shafts in the shredder have stopped. As a result of the responses generated by the sensor 55 the computer control 36 responds in a specific manner through the program established therein, as will be described hereinafter.

When the power pack of FIGS. 3 and 4 for the shredder 10 is initially energized by supplying current to motor 32 the flow reversing control valve 33 of FIG. 5 will normally be in its neutral position because centering springs function on the internal spool to position the spool in the centered position. At this time the solenoids 50 and 51 are not energized. When it is desired to operate the shredder 10 the computer start and forward control circuit 57 is initiated and a signal is transmited by lead 58 to solenoid 50 which shifts the valve spool toward the right such that the pressure fluid in line 41 is now transmitted by line 38 to the motor 17, and the fluid returns through lines 39 and 42 to the tank 27, as in an open loop circuit. It can be appreciated that the control over the drive motor 17 for the shredder is completely free of the pressure in the hydraulic fluid circuit, and this will permit full pressure to be delivered to the motor 17 so as to get the most efficient horsepower to fluid pressure relationship. In other words, the eddy current sensor does not care about the hydraulic pressure in the system, it only senses the condition of whether the operating elements of the shredder are either moving or not moving. While it is preferred to locate the eddy current sensor 55 in a non-contact position where it can conveniently count the passage of gear teeth and spaces between gear teeth, it is recognized that such a sensor 55 may be located at other places where it can be responsive to the movement or speed of any other component or element in the shredder 10 like its response to gear teeth and spaces.

Normally, the motor 17 will be expected to run in a forward direction when the start and forward circuit 57 is energized to signal solenoid 50 through lead 58 for shifting valve 33 to the right. The sensor 55 will generate signal pulses through lead 56 into the circuit 60 in response to the rotation of gear 22, or some other rotating element in the shredder. If, a jam occurs to stop rotation the sensor will respond and cease generating signals. This event in circuit 60 will initiate a timer to measure the duration of the cessation of rotation for the purpose of allowing the effect of the full hydraulic pressure on motor 17 to possibly break the jam before the measured time elapses. If the jam can be broken through, the circuit 60 will not terminate the normal function of circuit 57 and forward rotation will resume. However, if the measured time is used up circuit 60 will cause circuit 57 to deenergize solenoid 50 so the valve 33 will move to its neutral position so the pressure in lines 38 and 39 can be dumped back to tank 27. Concurrently, circuit 60 will energize circuit 61 where other timer devices will be excited in a predetermined sequence to effect energization of solenoid 51 through connected lead 62 to shift the valve 33 to the left to reverse the flow of pressure fluid for a predetermined time before deenergizing the solenoid 51 so the valve can return to its neutral position to again dump the pressure fluid to tank and stop the reverse rotation of motor 17. The time allowed for dumping the pressure fluid can be quite short before the circuit 61 will signal circuit 60 and 57 to energize solenoid 50 so motor 17 can resume forward rotation.

The several time intervals which control the sequence of functions are not new in relation to the overall control, as shredders heretofore sold have used such a timed system in association with pressure responsive sensing of the hydraulic motor operation. The application of solid state control and fast acting non-contacting eddy current sensor means substantially eliminates the problems encountered in the past types of controls. It can now be appreciated that in the preferred embodiment described above, the eddy current sensor functions to detect a jam in the shredder independently of the hydraulic pressure condition in the circuit to the hydraulic motor 17. Thus, the system is fully operative under a maximum pressure condition supplied by the pump 31 within, of course, the pressure setting of the valve 31A. This will allow the shredder to generate maximum torque and energy to the cutter shafts 18 and 19 and cause the shredding operation to take place at the full load of the motor 17. The presently preferred eddy current sensor which functions in cooperation with the computer control 36 allows full pressure to be applied to the motor 17, and the full pressure delivery is not sensed to indicate that the shafts 18 and 19 are jammed or have stopped.

The computer control 36 is a solid state device which completely eliminates the use of the older relay logic as is known in the prior art. The elimination of relay logic avoids the problems in the use of relays which are known to gather dirt, to result in pitting of the contact points, to be subject to vibration, bounce, or chatter in response to shocks or vibration, and to experience erratic operation. It is known, in shredders, that hydraulic reversal imparts vibration and shock to the components of the control system, and experience has shown that the relay logic performance is erratic and deteriorates with time, whereas computer control 36 eliminates all relays and moving components which improves reliability of the control. An important advantage for the computer control 36 in conjunction with the eddy current sensor 55 is that the performance and capacity of operation of the shredder 10 can be modified or tailored to a customer's needs without mechanical changes, and through modifications of the software type.

Another advantage of the presently preferred use of an eddy current or zero speed sensor is that, in addition to being able to allow delivery of full hydraulic pressure to the motor 17, especially when encountering hard to shred material, it is completely independent of the hydraulic fluid pressure, which adds a more positive way of control by being free of pressure variations in the hydraulic system.

What is claimed is:

1. Rotary shredding apparatus in which counterrotating shafts carry cooperating cutter elements for shredding material, the shredding apparatus comprising:

(a) counterrotating shafts and a reversible hydraulic motor operably connected to the counterrotating shafts for driving the same in a forward shredding motion and in a reverse direction;

(b) hydraulic fluid flow circuit means connected to said reversible motor and including a pump to supply fluid under pressure through said fluid flow circuit means;

(c) a pressure relief valve in said hydraulic fluid circuit means for imposing a predetermined upper limit on the pressure existing in said circuit means between said pump and reversible motor;

(d) motion responsive means in the shredding apparatus for generating signals continuously during the continuance of a forward shredding drive motion of the counterrotating shafts;

(e) hydraulic fluid flow directing valve means connected into said hydraulic fluid flow circuit means to direct the flow of hydraulic fluid at the predetermined pressure limit permitted by said pressure relief valve to said reversible hydraulic motor for determining the direction of drive for the counterrotating shafts; and (f) control means connected to said motion responsive means and said hydraulic fluid flow directing valve, said control means being operative in response to the continuous generation of signals by said motion responsive means for operating said hydraulic fluid flow directing valve to direct the pressure fluid at the predetermined upper limit in a direction for effecting the drive of said reversible hydraulic motor in a forward shredding motion direction, said control means being responsive to the cessation of signals by said motion responsive means for operating said hydraulic fluid flow directing valve to direct the pressure fluid at the predetermined upper limit in a direction for effecting the drive of said reversible hydraulic motor in a reverse direction for a predetermined time prior to returning to forward shredding.

2. The rotary shredding apparatus according to claim 1 wherein the reversible hydraulic motor is operably connected to the counterrotating shafts through a train of gears, and said motion responsive means is positioned adjacent said train of gears for generating signals during operation of said train of gears.

3. The rotary shredding apparatus according to claim 1 wherein said control means includes a counterrotating shaft jam sensor circuit responsive upon cessation of signals from said motion responsive means for sequencing said hydraulic fluid flow directing means to change said reversible hydraulic motor drive between a forward direction and reverse direction and timing the duration thereof, said sequencing from the forward to the reverse direction being delayed to allow the pressure fluid supply to said reversible hydraulic motor to continue driving the counterrotating shafts for a predetermined period of time in advance of initiating the sequencing of said hydraulic fluid flow control means to reverse said reversible hydraulic motor.

4. The rotary shredding apparatus according to claim 1 wherein a plurality of cooperating circuits are arranged in said control means so as to be responsive to the reception from said motion responsive means of signals and the cessation of signals by said motion responsive means for determining the timing for the operation of said hydraulic fluid flow directing valve from the first mentioned to the second mentioned operation.

5. The rotary shredding apparatus according to claim 1 wherein the first position of said hydraulic fluid flow directing valve supplies hydraulic pressure fluid to said hydraulic motor for operating said reversible hydraulic motor in a forward shredding direction so as to generate maximum torque within the hydraulic pressure limits permitted by said safety relief valve.

6. The rotary shredding apparatus according to claim 1 wherein said control means consists in a programmable computer, and said motion responsive means for generating signals is independent of influence from the pressure in said hydraulic fluid flow circuit.

7. Rotary shredding apparatus in which counterrotating shafts carry cooperating cutter elements for shredding material, the shredding apparatus comprising:

(a) counterrotating shafts and a reversible hydraulic motor operably connected to the counterrotating shafts for driving the same in a forward shredding motion and in a reverse direction;

(b) hydraulic fluid flow circuit means connected to said reversible motor and including a pump to supply fluid under pressure through said fluid flow circuit means;

(c) a pressure relief valve in said hydraulic fluid circuit means for imposing a predetermined upper limit on the pressure existing in said circuit means between said pump and reversible motor;

(d) means in the shredding apparatus for generating signals responsive to speed of the drive of the counterrotating shafts by said reversible hydraulic motor;

(e) hydraulic fluid flow directing valve means connected into said hydraulic fluid flow circuit means to direct the flow of hydraulic fluid at the predetermined pressure limit permitted by said pressure relief valve to said reversible hydraulic motor for determining the direction of drive for the counterrotating shafts; and (f) control means connected to said speed responsive means and to said hydraulic fluid flow directing valve, said control means being operative in response to the generation of signals by said speed responsive means for operating said hydraulic fluid flow directing valve to direct the pressure fluid in said hydraulic fluid flow circuit means for affecting the direction of rotation of said reversible hydraulic motor, and said control means being responsive to the cessation of signals from said speed responsive means for changing the direction of rotation of said hydraulic motor and such that for changing the direction of rotation of said hydraulic motor and such that for changing the direction reverse to the forward shredding direction the reverse rotation continues for a limited predetermined time period.

* * * * *